United States Patent [19]

Meadows

[11] Patent Number: 4,705,112

[45] Date of Patent: Nov. 10, 1987

[54] METHOD AND APPARATUS FOR EFFECTING AN OPENING IN A WELL CASING

[76] Inventor: Bernard A. Meadows, Rte. 4, P.O. Box 153, Elkton, Va. 22827

[21] Appl. No.: 892,870

[22] Filed: Aug. 4, 1986

[51] Int. Cl.[4] ..... E21B 29/06; E21B 33/14; E21B 41/00

[52] U.S. Cl. ..... 166/285; 166/88; 166/242; 166/380

[58] Field of Search ..... 166/287, 55, 55.6, 285, 166/242, 378, 380; 175/62

[56] References Cited

U.S. PATENT DOCUMENTS

| | | | |
|---|---|---|---|
| 3,403,730 | 10/1968 | Williams | 166/88 |
| 3,847,217 | 11/1974 | Krama et al. | 166/88 X |
| 4,308,916 | 1/1982 | Fritz, Jr. | 166/88 X |

*Primary Examiner*—Stephen J. Novosad
*Attorney, Agent, or Firm*—Mason, Fenwick & Lawrence

[57] ABSTRACT

A device for easily permitting effecting an opening in a well casing having a grouting wall therearound comprises: a tubular fitting having a circular transverse cross-section and having a first end and a second end, the first end configured to matingly engage the outer surface of the well casing, the length of said tubular fitting between the first and second ends thereof being substantially equal to the thickness of the grouting wall, a closure over the second end, and a coil spring attached to the tubular fitting for urging the first end of the tubular fitting against the outer surface of the well casing and for holding the tubular fitting in position on the casing. A method of providing a well casing to which access through surrounding grouting can be easily effected comprises the steps of positioning a well casing in the earth with an open clearance space between the outer surface of the well casing and the surrounding earth extending downwardly from the surface, positioning and holding a tubular fitting against the casing with one end of the fitting matingly engaging the surface of the casing and an opposite closed end being adjacent the surface of the surrounding earth, filling the clearance space with grouting, and permitting the grouting to harden.

21 Claims, 11 Drawing Figures

FIG-4-A
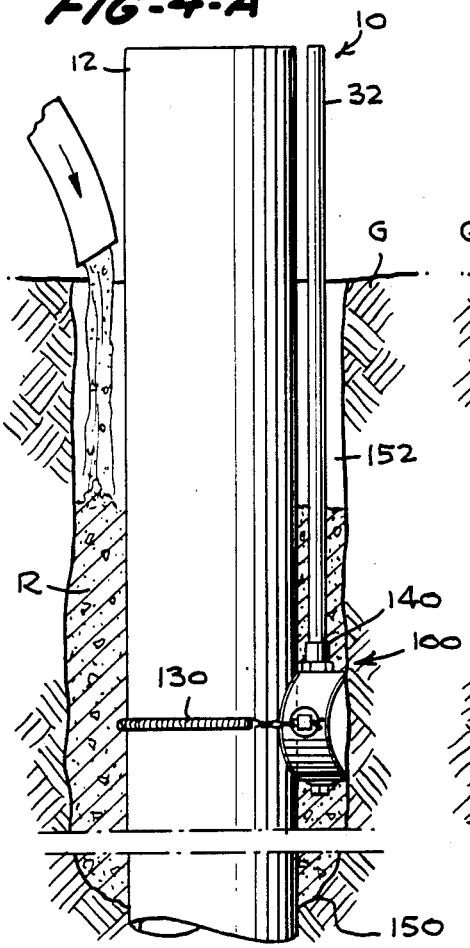
FIG-4-B
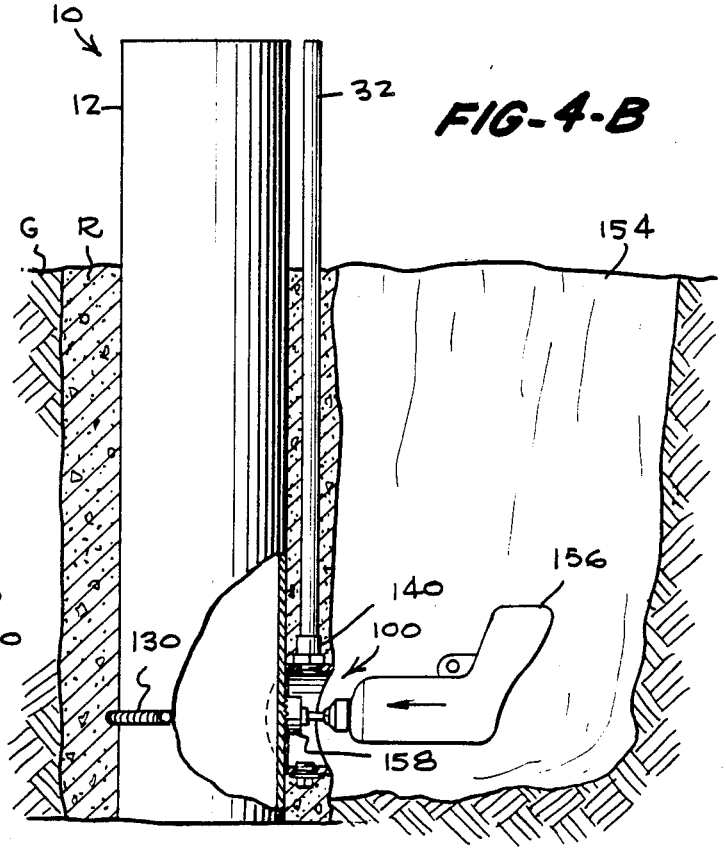
FIG-4-C
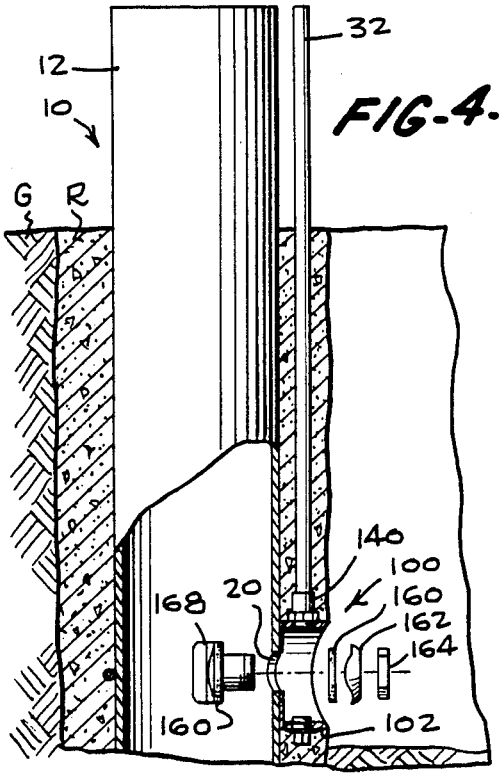
FIG-4-D
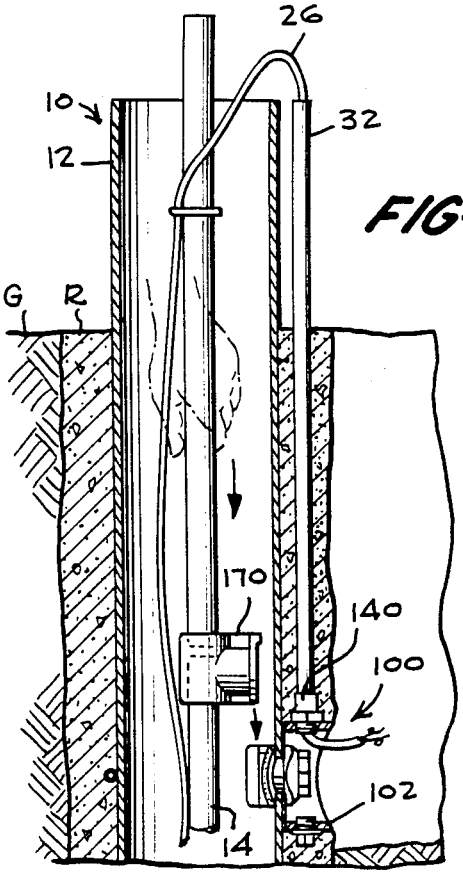

FIG-5
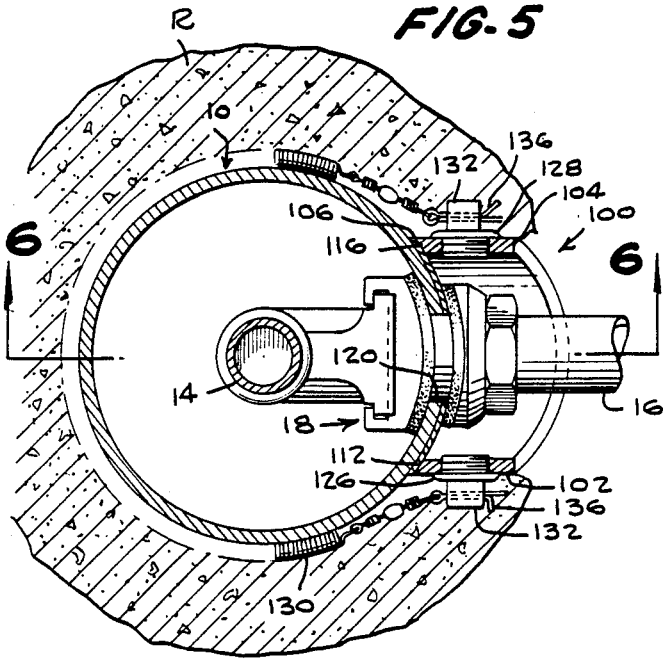
FIG-8
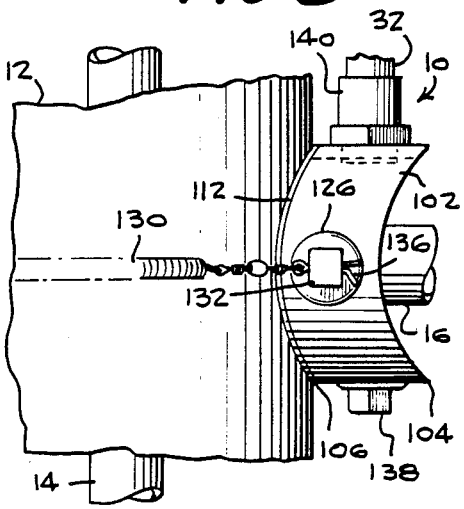
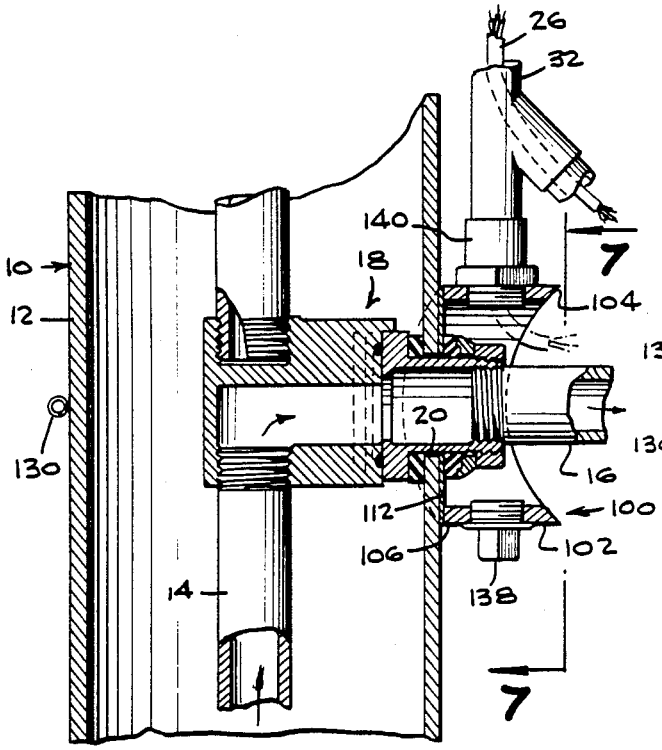
FIG-6
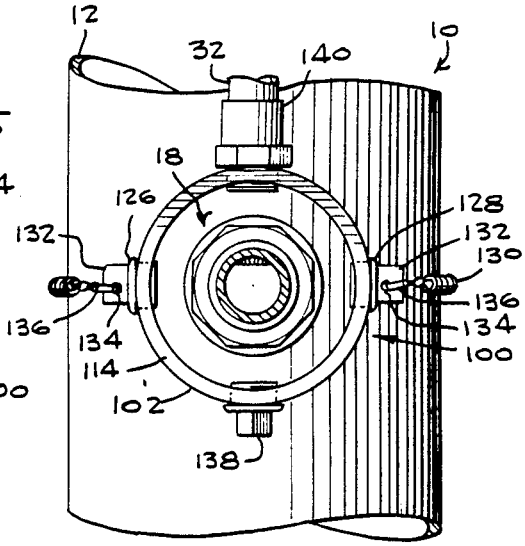
FIG-7

METHOD AND APPARATUS FOR EFFECTING AN OPENING IN A WELL CASING

BACKGROUND OF THE INVENTION

The present invention is directed to the field of wells such as water wells, and is more specifically directed to a method and apparatus for effecting an opening in the well casing of such a well which is surrounded by grouting in the form of a wall of cement or the like.

For wells such as water wells which are sunk vertically into the ground, the state laws of the various states require that the casing of the well be surrounded by grouting in the form of a cylindrical wall of cement or the like to a depth below the horizontal take-off pipe, the exact depth and width of the grouting being determined by the law of the particular state. Heretofore, it has been necessary to effect the connection between the horizontal take-off pipe and the vertical pipe of the well by first drilling through the cement grouting at the location where the horizontal take-off pipe is to be placed, and then drilling an opening through the pipe casing. It is not sufficient to drill straight through the grouting into the interior of the well casing, as an adapter having a diameter larger than that of the opening is commonly used on the outside of the well casing to effect the connection between the horizontal take-off pipe and the vertical pipe. Therefore, an area having a diameter larger than both the opening to be made in the well casing and the adapter must be cleared in the cement wall, and then the opening must be drilled in the well casing. This procedure is time-consuming and requires special tools and is therefore expensive. A further complication is that several different, standard sizes of pipe, e.g. 5 inches and 8 inches, can be used for the well casing. It is the solution of this and other problems which the present invention is directed.

SUMMARY OF THE INVENTION

Therefore, it is the primary object of this invention to provide a method and apparatus for effecting an opening in a well casing which avoids the necessity of clearing the cement grouting wall from the site of the opening.

It is another object of the invention to provide a method and apparatus for effecting an opening in a well casing which can be used with well casings of different sizes.

The foregoing and other objects are achieved by provision of a casing attached implement for placement at the site of the opening in the well casing comprising a tubular fitting having a circular cross-section, a holding element attached thereto for holding the fitting in place against the well casing, and first and second covers matingly engaging the ends of the fitting. The first end of the fitting has a cylinder portion surface adapted to matingly receive a portion of the side of a first cylinder having a first axis of curvature and a first diameter, while the second end of the fitting has a cylinder portion surface adapted to matingly receive a portion of the side of a second cylinder having a second axis of curvature substantially perpendicular to the first axis of curvature of the first cylinder and a second diameter different from the first diameter. The fitting also includes first and second pairs of internally-threaded, opposed apertures. The holding element is attached to the fitting at one pair of opposed apertures, and a pipe fitting for receiving the conduit which houses the electrical cable of the well pump is attached to one of the other pair of opposed apertures. The remaining aperture is closed by a plug.

The method for effecting the opening in the pipe casing is achieved by disposing the well casing in a well shaft in the ground concentric with the well shaft and providing on the outer surface of the well casing in the vicinity in which the opening is to be made a casing element substantially as described above for protecting the outer surface of the well casing and the surrounding area thereof. A grouting wall of cement or the like is formed in the well shaft around the well casing, an access shaft is excavated in the ground next to the retaining wall to expose the outwardly facing cover of the casing element, the exposed cover of the casing element is removed, and the remaining cover of the casing element and the well casing are drilled to effect the opening.

A better understanding of the subject invention will be achieved when the following written description is considered in conjunction with the appended drawings.

DESCRIPTION OF THE DRAWINGS

FIG. 4A is a side elevation which illustrates an initial step in the practice of the invention as shown in FIG. 3 with the pipe casing disposed in the ground and the grouting being poured;

FIG. 4B is a side elevation view, partially cut away, illustrating a subsequent step including provision of an access shaft excavated in the ground next to the casing element of the invention, the exposed cover of the casing being removed and a drill inserted into the casing element;

FIG. 4C is a side elevation, partially in section and exploded illustrating a step subsequent to that of FIG. 4B;

FIG. 4D is a cross-sectional view of the well casing and embodiment of the invention illustration a subsequent step to that illustrated in FIG. 4C, with the vertical water pipe of the well being placed in the adapter;

FIG. 5 is a cross-sectional view of the invention in connection with a water well taken along lines 5—5 of FIG. 1;

FIG. 6 is a cross-sectional view taken along lines 6—6 of FIG. 5;

FIG. 7 is a side elevational view, partially in section, taken along lines 7—7 of FIG. 6; and FIG. 8 is a side elevational view of the embodiment illustrated in FIG. 7 with a ground wire connected to the bottom of the casing element.

DESCRIPTION OF THE PREFERRED EMBODIMENTS

Figure 1:
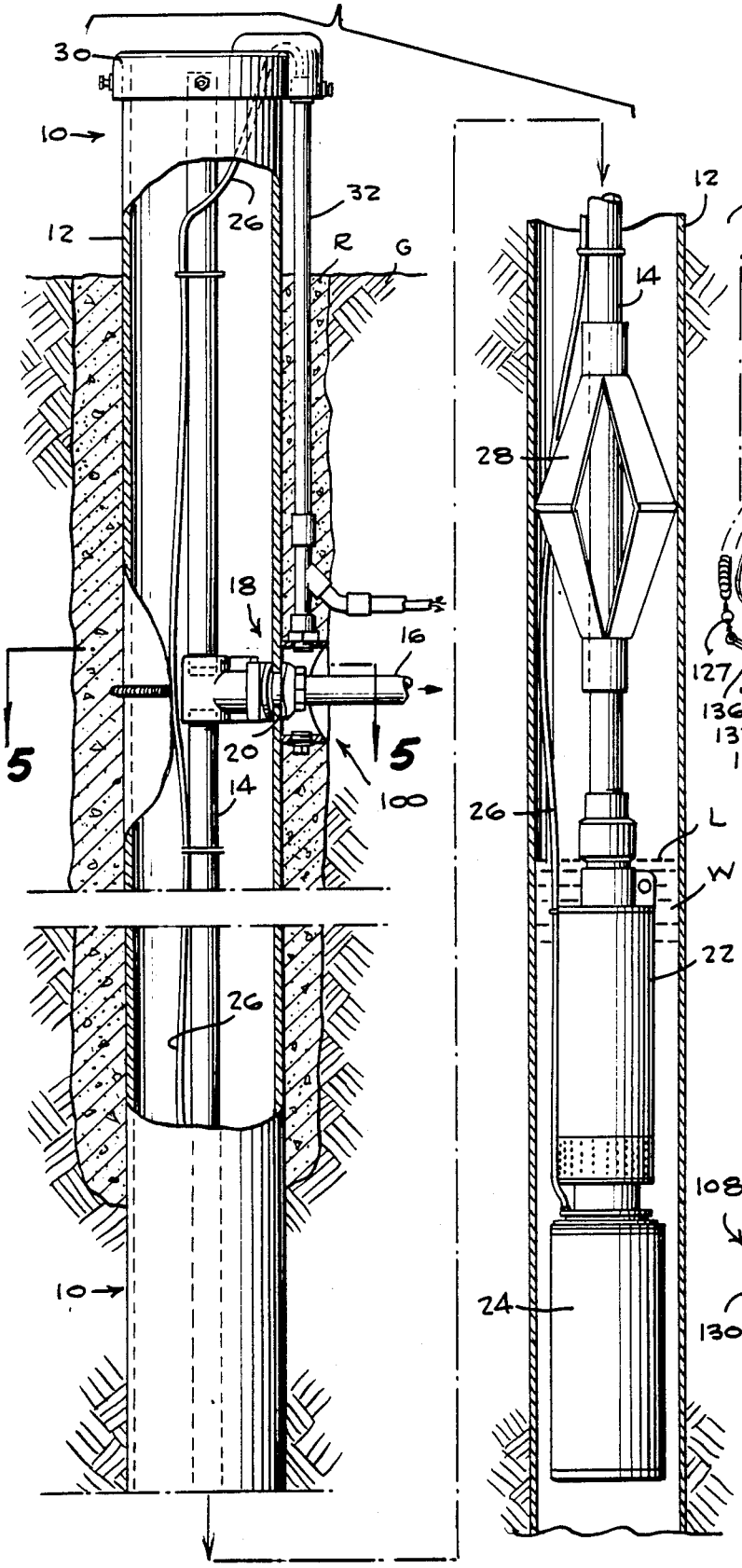
FIG. 1 is a side elevation, partially cut away and in section, illustrating a preferred embodiment of the invention in connection with a water well of standard configuration.

Referring now to FIG. 1, there is illustrated a water well 10 of a standard configuration well known in the art installed in the ground G, but employing a casing fitting 100 according to the invention for effecting an opening in the well casing of the well.

Water well 10 comprises a cylindrical casing 12, a vertical water pipe 14 positioned concentrically in well casing 12, a horizontal take-off pipe 16 through which water W is removed from water pipe 14, and a pitless adapter 18 for connecting water pipe 14 to take-off pipe 16 through an opening 20 in well casing 12. A pump 22 is connected to water pipe 14 below the water line L for pumping water W through water pipe 14. A motor 24 is connected to the bottom of pump 22 for operating pump 22, an electrical cable 26 is connected to an electrical supply (not shown) at one end and to motor 24 at the other end to supply power to motor 24, and a torque arrestor 28 is positioned around water pipe 14 above pump 22 to absorb the thrust of motor start-ups and keep water pipe 14 centered in well casing 12. A well cap 30 removably covers the top of well casing 12 for protecting the interior of well 10 and providing access thereto. An electrical conduit 32 for protecting electrical cable 26 underground is positioned adjacent and parallel to well casing 12. As previously stated, these parts are well-known in the art, and their construction and operation as also well-known.

In accordance with the laws of the various states, well casing 12 is surrounded by a grouting wall R of concrete or the like down to a depth below the point where take-off pipe 16 is connected to water pipe 14. The exact depth and width of wall R are specified by the particular state law. In order to effect an opening in well casing 12 through retaining wall R, the casing element 100 according to the invention is used.

Figure 2:
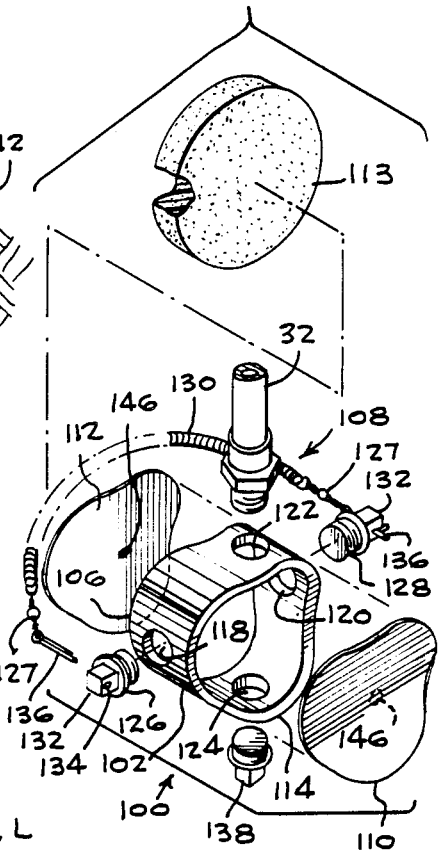
FIG. 2 is an exploded, perspective view of the embodiment of the invention illustrated in FIG. 1.
Figure 3:
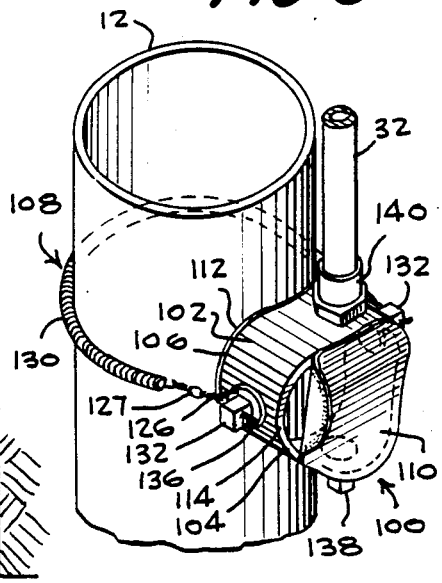
FIG. 3 is a perspective view of the embodiment as illustrated in FIG. 2, assembled and placed on the well casing.

Referring now to FIGS. 2 and 3, casing fitting 100 comprises a tubular fitting 102 having a circular transverse cross-section and having first and second ends 104 and 106, a holding device or means 108 including a coil spring 130 attached to fitting 102 for adjustably holding fitting 102 in place against well casing 12, and first and second covers 110 and 112 for matingly engaging first and second ends 104 and 106, respectively.

First end 104 of fitting 102 has a cylinder portion surface 114 adapted to matingly fit against or engage a portion of the side (i.e., a portion of the outer surface) of a first cylinder having a first axis of curvature and a first diameter, while second end 106 of fitting 102 has a cylinder portion surface 116 adapted to matingly fit against or engage a portion of the side of a cylinder having a second axis of curvature substantially perpendicular to the first axis of curvature of the first cylinder and a second diameter different from the first diameter. The first and second diameters of the first and second cylinders, respectively, correspond in length to the outside diameters of standard size pipe casing, for example, 5 inches and 8 inches. Thus, casing fitting 100 can be used on two different sizes of standard pipe casing, depending upon whether first cover 110 or second cover 112 is placed against the outer surface of the well casing. Casing fitting 100 can be used on other sizes of pipe casing by attaching an adapter, such as foam pad 113, to whichever of covers 110 or 112 is placed against the outer surface of the well casing, as shown in FIG. 2. By making the adapter of a thick (e.g. approximately ½–1 inch) compressible and resilient material, such as foam, a great number of variations in pipe diameter can be accommodated.

Because first and second surfaces 114 and 116 are adapted to matingly engage cylinders of different diameters the length of fitting 102 between ends 104 and 106 will vary slightly over the circumference of fitting 102. However, this variance is sufficiently small that the width of fitting 102 can be made to substantially equal to the width of grouting wall R. Where the well shaft has been made too wide, an adapter pad 113 can be used as shown in FIG. 2 to take up the extra space between fitting 102 and the wall of the well shaft. A tunnel in grouting wall R can thus be created between the area in which opening 20 is to be effected and the ground G surrounding retaining wall R, with at most a thin, easily removable shell of cement over whichever of covers 110 and 112 is outermost.

Fitting 102 also has a first pair of internally-threaded opposed apertures 118 and 120 positioned on a diameter of fitting 102 parallel to the first axis of curvature of the first cylinder, and a second pair of internally-threaded opposed apertures 122 and 124 of the same size of the first pair and positioned on a diameter of fitting 102 parallel to the second axis of curvature of the second cylinder, for a purpose to be described in detail hereinafter. First and second pairs of apertures 118 and 120 and 122 and 124 are therefore diametrically positioned substantially mutually perpendicular to each other on fitting 102, i.e., apertures 118, 120, 122, and 124 are evenly spaced around the circumference of fitting 102. However, first pair of apertures 118 and 120 need not be on the same circumference of fitting 102 as second pair of apertures 122 and 124. In fact, if each pair of apertures is centered between ends 104 and 106 as shown in FIGS. 2 and 3, then they must be on different circumferences of fitting 102.

Holding device 108 comprises a pair of externally-threaded plugs 126 and 128 adapted to matingly engage either of first and second pairs of apertures 118 and 120 and 122 and 124 (as illustrated herein, first pair of plugs 118 and 120), coil spring 130 of sufficient length when attached to fitting 102 to encircle pipe casing 12, and rotary coupling means 127 for attaching coil spring 130 to plugs 126 and 128. As illustrated in FIGS. 2 and 3, a block 132 is attached to the end of each plug 126 and 128, block 132 having a hole 134 extending therethrough, and a cotter pin is attached to each rotary coupling means 127 for insertion into hole 134. It should be understood that holding device 108 is not to be limited to a coil spring, but that the resilience of coil spring 130 enables the position of fitting 102 to be easily changed in either direction along the vertical axis of well casing 12, while providing engagement between well casing 12 and either of first and second covers 110 and 112 of casing fitting 100. The rotary couplings 127 permit the spring 130 to roll down the casing when moved from the top of the casing to its use position illustrated in FIG. 1.

An externally-threaded plug 138 is provided to matingly engage one of the second pair of apertures 122 and 124, while an externally-threaded pipe fitting 140 is provided to matingly engage the other of the second pair of apertures 122 and 124 to matingly receive electrical conduit 132.

Because mating plugs 118, 120, and 138 and pipe fitting 140 are all interchangeable in apertures 118, 120, 122, and 124, the orientation of casing fitting 100 with respect to well casing 12 can easily be changed to accommodate well casings of two different diameters. Specifically, if first cover 110 were to be placed against well casing 12, plugs 126 and 128 would be placed in apertures 122 and 124 to attach holding device 108, and plug 138 and pipe fitting 140 would be placed in apertures 122 and 124. Likewise, if second cover 112 were to be placed against well casing 12, fitting 102 would be rotated 90 degrees, and as shown in FIGS. 2 and 3, plugs 126 and 128 would be placed in apertures 118 and 120 and plug 138 and pipe fitting 140 would be placed in apertures 124 and 122.

It should be understood that apertures 118, 120, 122, and 124, plugs 126, 128, and 138, and pipe fitting 140 need not be threaded as long as some kind of sealing engagement is made between them, for example by gluing, so that unset cement cannot enter fitting 102 when plugs 126, 128, and 138 and pipe fitting 140 are in place.

First and second covers 110 and 112 are attached to fitting 102 by an adhesive or by molding or by other means which provides a relatively good seal between covers 110 and 112 and fitting 102 but which still can be cut through by a knife or similar sharp-edged implement to allow cover 110 or 112 to be pried off using a screwdriver or the like. By a relatively good seal is meant a seal sufficient to prevent covers 110 and 112 from popping off or becoming dislodged if a rock or other small obstruction is encountered while casing fitting 100 is being positioned.

Preferably, fitting 102, plugs 126, 128, and 138 are made from PVC plastic. However, other materials for fitting 102 which can easily be cut or otherwise formed to the necessary configuration and stand also the weight of the surrounding grouting cement, are suitable, and plugs 126, 128, and 138 can be made of any material compatible with fitting 102. Pipe fitting 140 (and conduit 32 which is attached thereto) preferably are formed of a metal which will not melt when subjected to heat from a torch as discussed hereafter.

First and second covers 110 and 112 also preferably are made of PVC plastic, although other materials are suitable. In choosing a material for covers 110 and 112, it is preferable to choose a material which is flexible, so that covers 110 and 112 can be cut or otherwise formed from a planar piece of material, then bent upon assembly to engage surfaces 114 and 116. However, this characteristic only makes assembly of covers 110 and 112 easier, and is not absolutely necessary. If covers 110 and 112 are molded then they should be sufficiently thin to be readily cut through by a sharp tool for removal from fitting 102. Each cover 110 and 112 can also include a center mark 146, embossed in the material or added using a marking device, for a purpose to be described hereinafter.

Referring now to FIGS. 4–8, and more particularly to FIGS. 4A–4D, there is illustrated the method of the invention. In the method of the invention, a well shaft is provided in the ground G, the bottom portion 150 of which corresponds substantially in diameter to the diameter of well casing 12, and the top portion 152 of which has a diameter greater than the diameter of well casing 12 to provide an open clearance space between the outer surface of well casing 12 and the surrounding earth, the depth and width of the top portion 152 being dictated by the depth and width of the grouting wall R to be formed. Well casing 12 is then disposed in the hole, and casing fitting 100 is positioned on well casing 12 so that fitting 102 covers the exact location in which opening 20 is to be effected and pipe fitting 140 faces the top of the well, with electrical conduit 32 connected to pipe fitting 140. Alternatively, casing fitting 100 can be placed on well casing 12 before well casing 12 is disposed in the well shaft. Conveniently, electrical conduit 32 can be used to move casing fitting 100 vertically and horizontally on well casing 12 to its precise position. Grouting cement is then poured into upper portion 152 of the hole and allowed to harden, forming grouting wall R.

As shown in FIG. 4B, once grouting wall R has been formed, an access shaft 154 is excavated next to grouting wall R parallel to electrical conduit 32 down to the depth of casing fitting 100, exposing outward facing first cover 110 (see FIG. 3). If a thin shell of cement is present, it can easily be chipped away with hand tools, such as a chisel. Cover 110 is then removed, for example by loosening the adhesive with a knife and prying cover 110 away with a screwdriver. A drill 156 having a circular bit 158 can then be inserted into access shaft 154 with circular bit 158 placed inside fitting 102. An opening is then drilled through cover 112 and well casing 12, using center mark 146 as a guide for placement of circular drill bit 158. A torch can be used in place of drill 156 to effect the opening through cover 112 and well casing 12. Because a torch will melt PVC plastic, all parts which are needed and must remain intact after the opening is effected, i.e. fitting 140 and conduit 32, must be made of a metal which will not melt when subjected to the heat from the torch.

Once opening 20 has been effected, adapter 18 can be installed according to standard procedures. As shown in FIGS. 4C and 4D, the opening in grouting wall R provided by fitting 102 is large enough to receive the outer washer 160, outer contoured spacer 162, and outer nut 164 of pitless adapter 18; these are then used to secure inner washer 166 and inner sleeve 168 of pitless adapter 18 inside pipe casing 12. At this stage, electrical cable 126 is threaded into electrical conduit 32; and joint 170, which holds water pipe 14, can be inserted into inner sleeve 168. It should be noted that electrical conduit 26 can be fed into the ground G via fitting 102, as shown in FIGS. 4D and 6, or via electrical conduit 32 above fitting 102, as alternatively shown in FIG. 6.

Thus, it will be seen that all embodiments of the present invention provide a unique method and apparatus for effecting an opening in the casing of a well surrounded by a grouting wall of cement or the like. Moreover, the operation of the device is both effective and easy to accomplish so as to render use of all embodiments convenient to users. While preferred embodiments of the invention have been disclosed, it should be understood that the spirit and scope of the invention are to be limited solely by the appended claims, since numerous modifications of the disclosed embodiments will undoubtedly occur to those of skill in the art.

I claim:

1. A device for easily permitting effecting an opening in a well casing having a grouting wall therearound, comprising:

a tubular fitting having a circular transverse cross-section and having a first end and a second end, said first end configured to matingly engage the outer surface of the well casing, the length of said tubular fitting between said first and second ends thereof varying only very slightly over the circumference of said fitting, whereby the length of said tubular fitting between said first and said second ends thereof is substantially equal to the thickness of the grouting wall;

closure means over said second end; and holding means attached to said tubular fitting for urging said first end of said first tubular fitting against the outer surface of the well casing and for holding said tubular fitting in position on the casing.

2. The device of claim 1, wherein said second end is also configured to matingly engage the outer surface of a well casing.

3. The device of claim 2, wherein said first and second ends are configured to matingly engage the outer surface of well casings of different diameters.

4. The device of claim 2, wherein said first and second ends have surfaces having axes of curvature substantially perpendicular to each other.

5. The device of claim 1, further comprising closure means over said first end.

6. The device of claim 5, further comprising compressible, resilient adapter means over said closure means over said first end.

7. The device of claim 1, further comprising connector means for attaching an electrical conduit to said tubular fitting.

8. The device of claim 7, said connector means comprising pipe fitting means and an aperture in said tubular fitting for matingly engaging said pipe fitting means.

9. The device of claim 1, said holding means comprising spring means.

10. The device of claim 9, said holding means further comprising rotary coupling means connecting said spring means to said tubular fitting.

11. The device of claim 4, said holding means comprising spring means.

12. The device of claim 11, said tubular fitting further comprising first and second attachment permitting means for permitting selective attachment of said holding means to said tubular fitting on either a first diameter or a second diameter of said tubular fitting, said first and second diameters being mutually perpendicular.

13. The device of claim 12, said first attachment permitting means comprising a first pair of opposed apertures in said tubular fitting and said second attachment permitting means comprising a second pair of opposed apertures in said tubular fitting; and said said holding means further comprising first and second plug means for matingly engaging either of said pairs of apertures and rotary coupling means for attaching the ends of said spring means to said first and second plug means.

14. A device for permitting effecting an opening in a well casing having a grouting wall therearound, comprising:

a tubular fitting having a circular transverse cross-section and having a first end and a second end, said first end having a cylinder portion surface adapted to matingly engage a portion of the side of a first cylindrical surface, and said second end having a cylinder portion surface adapted to matingly engage a portion of the side of a second cylindrical surface, said cylinder portion surfaces having non-parallel axes of curvature, the length of said tubular fitting between said first and second ends thereof being substantially equal to the width of the grouting wall, and said tubular fitting further having first and second pairs of opposed apertures of equal size therein, said first pair of apertures being positioned on a diameter of said tubular fitting substantially parallel to the axis of curvature of said first cylinder portion surface and said second pair of apertures being positioned on a diameter of said tubular fitting substantially parallel to the axis of curvature of said second cylinder portion surface;

holding means sealingly engaging one of said first and second pairs of apertures for adjustably holding said tubular fitting in place against the well casing;

means for sealing the other of said first and second pairs of apertures; and first and second closure means matingly engaging said first and second cylinder portion surfaces, respectively, of said tubular fitting.

15. The device of claim 14, wherein said first and second cylinder portion surfaces have different diameters.

16. The device of claim 14, said sealing means including plug means for sealingly engaging one aperture of the other of said first and second pairs of apertures.

17. The device of claim 14, said sealing means including pipe fitting means for matingly engaging at one end thereof one aperture of the other of said first and second pairs of apertures and for matingly receiving electrical conduit means at the other end thereof.

18. The device of claim 14, said holding means comprising first and second plug means for matingly engaging said apertures, spring means, and first and second coupling means for attaching the ends of said spring means to said first and second plug means, respectively.

19. The device of claim 18, said coupling means comprising rotary coupling means.

20. A method of providing a well casing to which access through surrounding grouting can be easily effected, said method comprising the steps of:

positioning a well casing in the earth with an open clearance space between the outer surface of the well casing and the surrounding earth extending downwardly from the surface;

positioning and holding a tubular fitting against the casing with one end of the fitting matingly engaging the surface of the casing and an opposite closed end being adjacent the surface of the surrounding earth;

filling the clearance space with grouting; and permitting the grouting to harden.

21. The method of claim 20, further comprising after said positioning and holding step, the step of providing the tubular fitting with an electrical conduit extending therefrom substantially parallel to said well casing.

* * * * *